US006311529B1

(12) United States Patent
Kang

(10) Patent No.: US 6,311,529 B1
(45) Date of Patent: Nov. 6, 2001

(54) HANDCUFFS

(76) Inventor: Jae-Bong Kang, 117-7 Chuneui-dong, Wonmi-gu, Buchun City, Kyounggi-do (KR)

( * ) Notice: Subject to any disclaimer, the term of this patent is extended or adjusted under 35 U.S.C. 154(b) by 0 days.

(21) Appl. No.: 09/607,436

(22) Filed: Jun. 29, 2000

(51) Int. Cl.[7] ..... E05B 75/00
(52) U.S. Cl. ..... 70/16
(58) Field of Search ..... 70/14–19

(56) References Cited

U.S. PATENT DOCUMENTS

| | | | | |
|---|---|---|---|---|
| 1,456,846 | * | 5/1923 | Gamwell | 70/16 |
| 1,579,333 | * | 4/1926 | Neal | 70/16 |
| 1,856,427 | * | 5/1932 | Pratt | 70/16 X |
| 1,890,748 | * | 12/1932 | Pratt | 70/16 X |
| 2,516,878 | * | 8/1950 | Howe | 70/16 |
| 4,138,867 | | 2/1979 | Tompkins | 70/16 |
| 5,138,852 | * | 8/1992 | Corcoran | 70/16 |
| 5,613,381 | * | 3/1997 | Savage | 70/16 |
| 5,687,593 | * | 11/1997 | Cross | 70/16 |

FOREIGN PATENT DOCUMENTS

| | | | | |
|---|---|---|---|---|
| 741000 | * | 11/1955 | (GB) | 70/16 |
| 07301041 | | 11/1995 | (JP) . | |

* cited by examiner

*Primary Examiner*—Suzanne Dino Barrett
(74) *Attorney, Agent, or Firm*—Thorpe North & Western

(57) ABSTRACT

A handcuff includes cheek and jaw members pivotally secured and movable between open and closed positions. Teeth are formed on the jaw member, and a locking mechanism is carried by the cheek member. The locking mechanism includes one or more primary gears having a plurality of teeth that engage the teeth of the jaw member in the closed position and rotate as the cheek and jaw members pivot. A secondary gear may be secured to and rotatable with the primary gear. A latch may pivot to releasably engage the secondary gear, to prevent the secondary and primary gears from rotating, and to prevent the cheek and jaw members from moving to the open position. The locking mechanism may include a pair of spaced-apart primary gears with the latch disposed therebetween. The jaw member and gear may be disposed in a planar layer, and the latch may be disposed outside the planar layer defined by the jaw member and gear.

26 Claims, 10 Drawing Sheets

HANDCUFFS

BACKGROUND OF THE INVENTION

1. The Field of the Invention.

The present invention relates generally to handcuffs. More particularly, the present invention relates to an improved locking mechanism for handcuffs.

2. The Background Art.

It is sometimes necessary to restrain people. Such a situation frequently occurs in law enforcement, in which police or officials must restrain a criminal or suspect for protection of the police, the criminal and/or the general public. Law enforcement officials commonly restrain a person using a pair of handcuffs.

Typical handcuffs commonly include a pair of handcuffs chained or hinged together. Each handcuff typically includes a cheek or main body, and a secondary body or jaw pivotally coupled to the cheek. The cheek typically includes a lock which engages teeth formed on the jaw.

Typical handcuff locks commonly include a pawl member, movably disposed to engage the teeth of the jaw. A spring member forces the pawl against the jaw.

One disadvantage with many typical handcuff locks is their susceptibility to tampering and unauthorized release. For example, a gap may exist between the teeth of the jaw member and the cheek member in which a foreign object may be inserted, displacing the pawl and moving it away from the teeth of the jaw, thus releasing the handcuffs. The gap may be required for clearance.

SUMMARY OF THE INVENTION

It has been recognized that it would be advantageous to develop a handcuff and/or handcuff locking mechanism which resists tampering and/or unauthorized release. In addition, it has been recognized that it would be advantageous to develop a handcuff and/or handcuff locking mechanism which resists insertion of foreign objects to interfere with critical parts of the locking mechanism. In addition, it has been recognized that it would be advantageous to develop a handcuff and/or handcuff locking mechanism that resists displacement of critical parts of the locking mechanism.

The invention provides a handcuff with a locking mechanism that resists unauthorized tampering and release. The handcuff includes cheek and jaw members pivotally secured and movable between open and closed positions. Teeth are formed on the jaw member. The locking mechanism is carried by the cheek member and includes a plurality of gears, at least one of which has a plurality of teeth that engage the teeth of the jaw member in the closed position and rotate as the cheek and jaw members pivot. The lock mechanism also includes a latch that pivots to engage at least one of the gears to prevent the gears from rotating, and thus to prevent the cheek and jaw members from moving to the open position. The latch may pivot between (i) a lock position in which the latch prevents rotation of the pair of gears, and thus prevents pivoting of the cheek and jaw members to the open position, and (ii) an unlock position in which the latch allows rotation of the pair of gears, and thus allows pivoting of the cheek and jaw members to the open position.

In accordance with one more detailed aspect of the present invention, the locking mechanism may include primary and secondary gears secured together and rotatable together. The latch may pivot to releasably engage the secondary gear.

In accordance with another more detailed aspect of the present invention, the jaw member and primary gear may be disposed in a planar layer, while the latch and secondary gear may be disposed outside the planar layer to resist tampering.

In accordance with another more detailed aspect of the present invention, the locking mechanism may include a pair of spaced-apart gears. The latch may be disposed between the pair of spaced-apart gears to prevent tampering.

In accordance with another more detailed aspect of the present invention, the locking mechanism may include first and second, spaced-apart gear assemblies, each having primary and secondary gears. The primary gears may engage the jaw member in the closed position and rotate as the cheek and jaw members pivot. The secondary gears may be secured to and rotatable with the respective primary gears. The latch may engage both of the secondary gears, to prevent the secondary and primary gears from rotating, and to prevent the cheek and jaw members from moving to the open position.

Preferably, pivotal movement of the cheek and jaw members may be away from one another in an open direction, and may exert a force tending to cause the gear assemblies to rotate in a release direction. Preferably, the latch is oriented with respect to the gear assemblies such that any rotation of the gear assemblies in the release direction exerts a force on the latch tending to cause the latch to pivot towards a lock position.

In accordance with another more detailed aspect of the present invention, a spring member may engage the latch to force the latch to engage at least one of the gears.

In accordance with another more detailed aspect of the present invention, a stop member may be selectively movable between (i) a first stop position abutting to the latch to prevent the latch from pivoting, and (ii) a second free position to allow the latch to pivot.

Additional features and advantages of the invention will be set forth in the detailed description which follows, taken in conjunction with the accompanying drawing, which together illustrate by way of example, the features of the invention.

DETAILED DESCRIPTION

Figure 1:
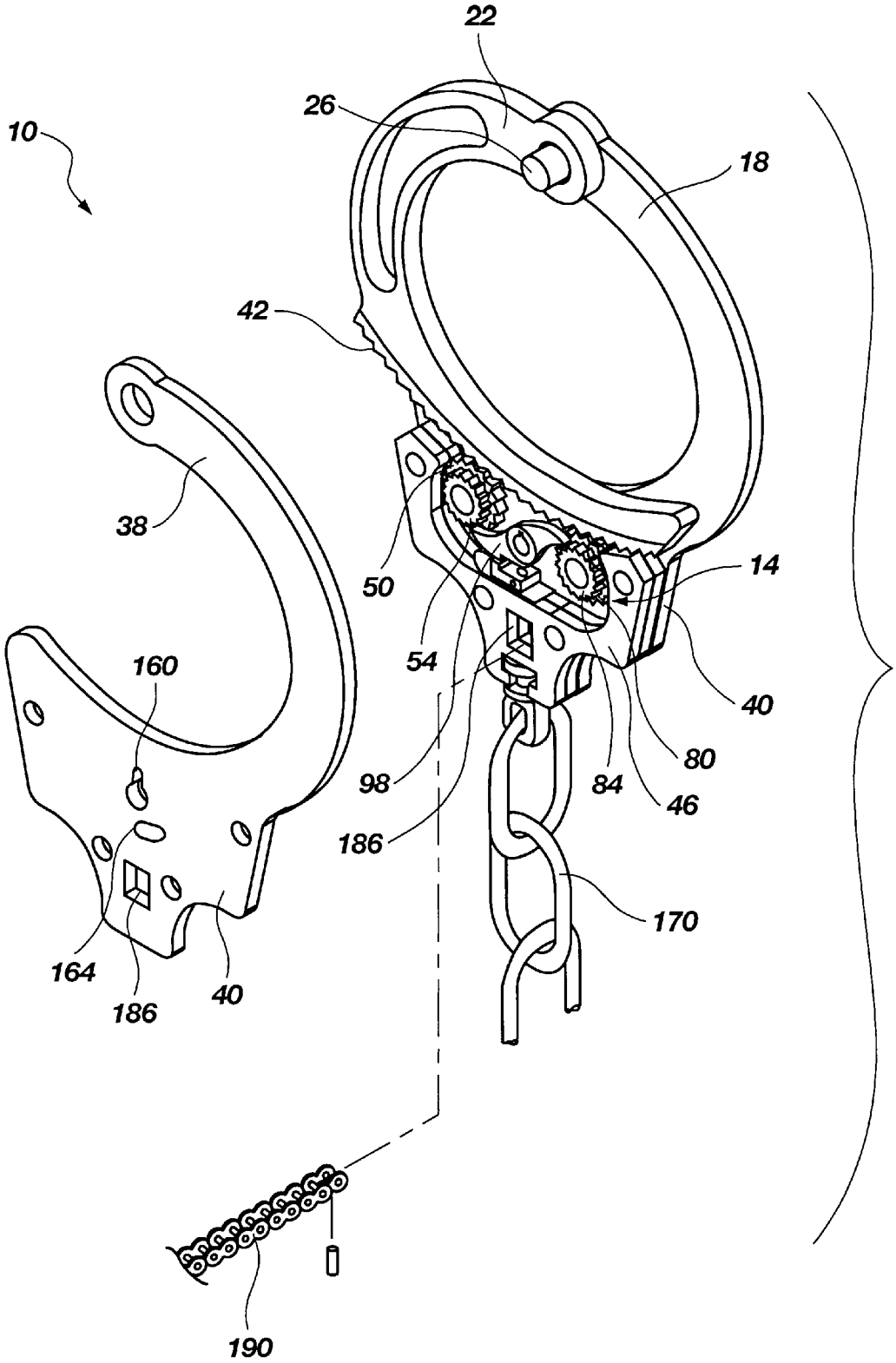
FIG. 1 is a partially exploded perspective view of a handcuff in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
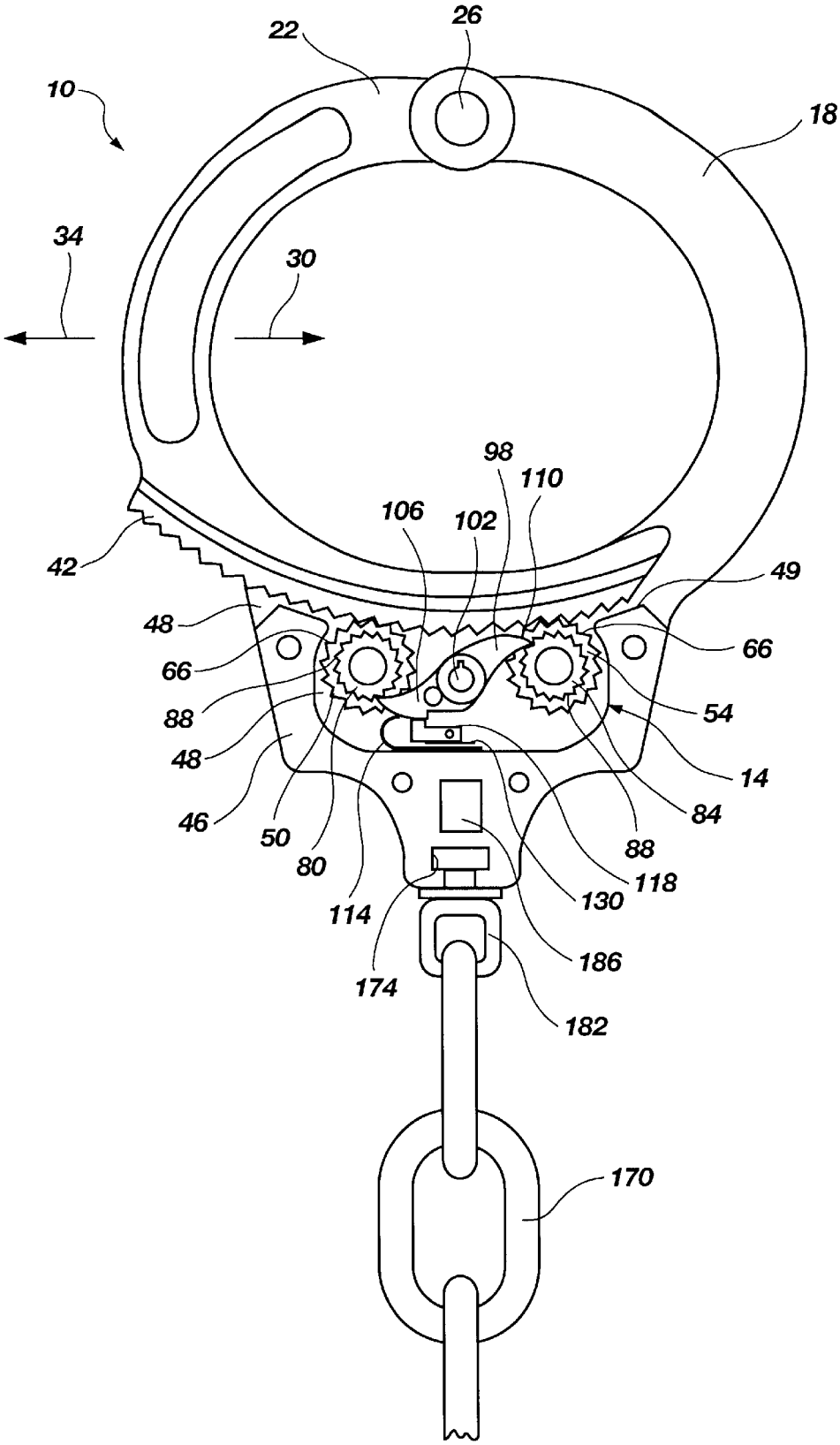
FIG. 2 is a broken away side view of the handcuff of FIG. 1.
Figure 3:
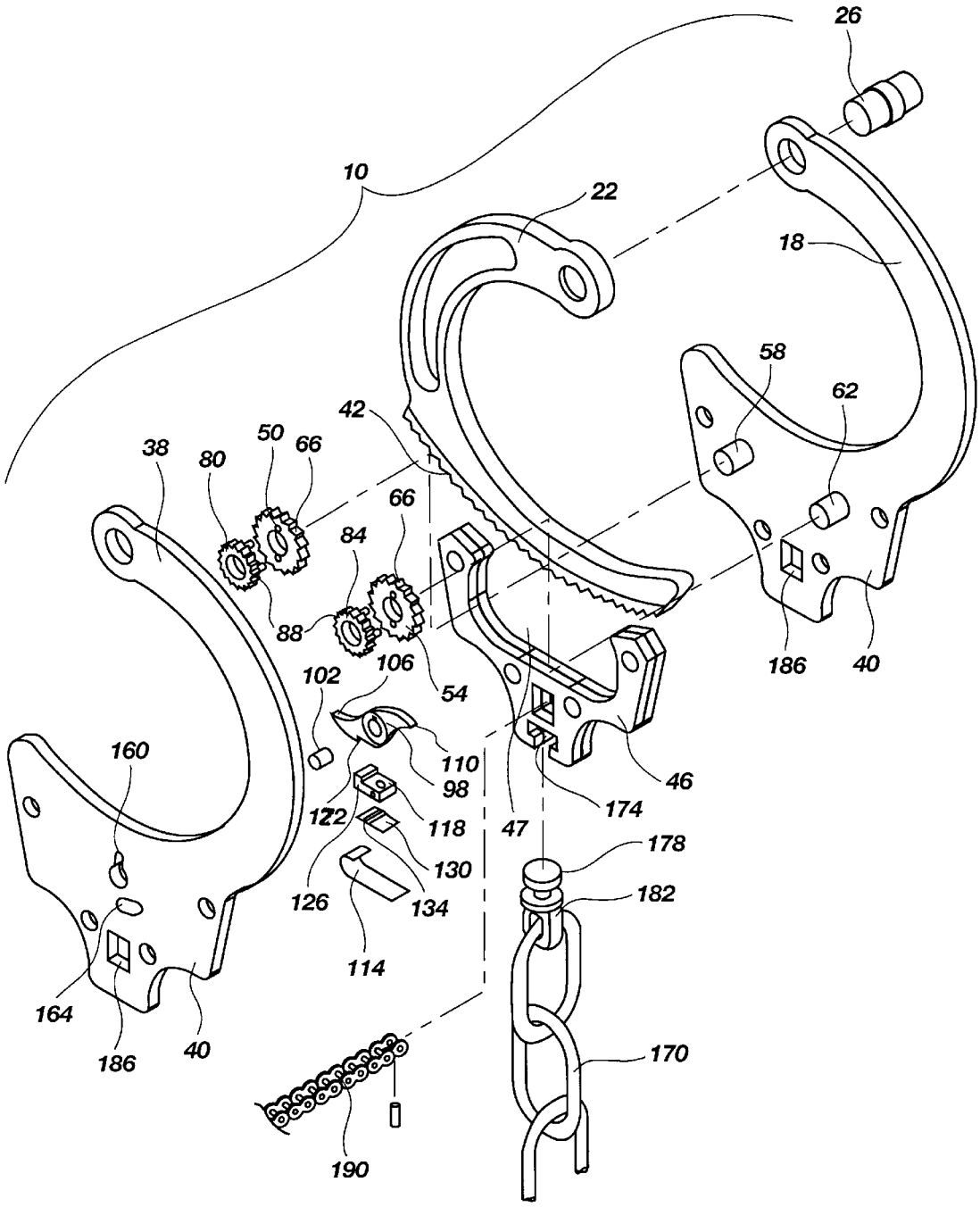
FIG. 3 is an exploded view of the handcuff of FIG. 1.

As illustrated in FIGS. 1–3, a handcuff, indicated generally at 10, is shown with a locking mechanism, indicated generally at 14, in accordance with the present invention. The term "handcuffs" is used broadly herein to refer to any type of handcuff, pairs or handcuffs, shackles, restraining devices, and the like. The handcuff may include a single handcuff, or may be provided as a pair of handcuffs with two handcuffs chained together, or any other configuration. Law enforcement is an example of one field which may benefit from the use of such a handcuff 10 and/or locking mechanism 14.

The handcuff 10 generally includes a cheek member 18 and a jaw member 22 which are pivotally secured at a pivot pin 26 or hinge. The cheek and jaw members 18 and 22 are pivotally coupled at their distal ends, and releasably secured at their proximal ends. The cheek and jaw members 18 and 22 pivot with respect to each other between an open position (not shown) and a closed position as shown in FIG. 2. In the open position, the cheek and jaw members 18 and 22 are open to receive a user's wrist, ankle, or other object. In the closed position, the cheek and jaw members 18 and 22 form a ring for surrounding a wrist or ankle of a user, or another object. The cheek and jaw members 18 and 22 pivot in a closed direction, indicated by arrow 30, towards one another to form the ring, which reduces in size to match the wrist and/or ankle of the user, or other object. It will be appreciated that the cheek and jaw members 18 and 22 may be secured around the wrist or ankle of a user, and may be reduced in size to match the wrist or ankle of the user to prevent the user from withdrawing his hand or foot through the ring. The cheek and jaw members 18 and 22 also pivot in an open direction, as indicated by arrow 34, away from one another.

The cheek member 18 may be a main body with an arcuate shape. In addition, the cheek member 18 may include a pair of cheek members 18 and 38, with the jaw member 22 movably disposed therebetween. Thus, a space is formed between the pair of cheek members 18 and 38, and the jaw member 22 may pivot a full 360 degrees by passing through the space therebetween. The cheek members 18 and 38 may be flat or plate-like members which are cut or shaped to form an arcuate portion and a lock housing 40. The lock mechanism 14 preferably is carried by the cheek member 18 or members 18 and 38, which may be located at the proximal end.

The jaw member 22 also may have an arcuate shape. A plurality of teeth 42 are formed on the proximal end of the jaw member 22 to face the locking mechanism 14 when in the closed position. The jaw member 22 similarly may be a relatively flat or plate-like member shaped into a broad arc. The cheek and jaw members 18, 38, and 22 preferably are formed of a rigid and strong material, such as steel, and may be formed by stamping or forging. It is of course understood that the cheek and jaw members 18, 22 and 38 may be formed in any appropriate shape.

As stated above, the cheek members 18 and 38 may be spaced apart to form the outer sides of a lock housing 40. One or more inner members 46 may be fixedly disposed between the cheek members 18 and 38 to form the ends and sides of the lock housing 40. The inner member 46 may be generally c-shaped with the opening facing towards the jaw member 22 when in the closed position. Thus, the inner member 46 forms a cavity 47 therein, and between the cheek members 18 and 38, in which the locking mechanism 14 is disposed. The one or more inner members 46 similarly may be flat or plate-like members, and formed of a rigid or hard material such as steel. Thus, the cheek members 18 and 38 form outer layers while the jaw member 22 and inner member 46 may form a common inner layer. The cheek members 18 and 38 and the one or more inner members 46 may be secured together such as by rivets or the like (not shown) disposed through a plurality of holes formed in the members 18, 38 and 46.

It will be appreciated that the lock housing 40 has an opening therein which faces towards the ring, or towards the jaw member 22 when in the closed position. The opening in the lock housing 40 allows the teeth 42 of the jaw member 22 to be engaged by the locking mechanism 14. In the closed position, the proximal end of the jaw member 22 is disposed across the opening and the lock housing 40. In the closed position, the cheek members 18 and 38, inner member 46, and proximal end of the jaw member 22 substantially enclose the locking mechanism 14. It will be appreciated, however, that gaps 48 and 49 or openings may be formed between the distal end of the jaw member 22 and the lock housing 40, or the inner member 46. Such gaps 48 and 49 or spaces may be required as a clearance or tolerance for the jaw member 22 to pivot with respect to the cheek members 18 and 38, or for the teeth 42 at the proximal end of the jaw member 22 to move past the inner member 46.

The locking mechanism 14 of the present invention advantageously includes one or more gears or gear members. The gear or gear members include a plurality of teeth which engage and intermesh with the teeth 42 of the jaw member 22. The gear or gear members advantageously rotate when engaged by the teeth 42 of the jaw member 22 as the jaw member pivots with respect to the cheek member 18. The gear or gear members advantageously may be coupled to the lock housing 40 or cheek members 18 or 38 to pivot, but not displace. Thus, the gear or gear member rotates when engaged by the jaw member 22 without displacing. Therefore, the locking mechanism 14 advantageously resists unauthorized release from the insertion of a foreign object between the jaw member 22 and inner member 46 because the gear or gear member may not be displaced away from the teeth 42 of the jaw member 22, such as with prior art pawl-type devices.

Preferably, the locking mechanism 14 of the present invention advantageously includes a pair of gears or gear members 50 and 54 disposed in a spaced apart relationship. Thus, the two gears 50 and 54 may be disposed on either side of the lock housing 40, and near any gap 48 and 49 formed at either side of the lock housing 40 between the inner member 46 and the proximal end of the jaw member 22. Therefore, each gear 50 and 54 is located to resist the insertion of a foreign object into the lock housing 40.

Each gear 50 and 54 may be pivotally secured to the cheek member 18, or members 18 and 38, and rotate about pins 58 and 62 which may be carried by the cheek member 18. The pins 58 and 62 preferably are fixed to the lock housing 40 or cheek members 18 or 38 to prevent displacement of the gears 50 and 54. The gears 50 and 54 also include a plurality of teeth 66 which engage and intermesh with the teeth 42 of the jaw member 22. Thus, as the jaw 22 pivots with respect to the cheek member 18, the teeth 42 of the jaw member 22 engage the teeth 66 of the gears 50 and 54, and the gears 50 and 54 rotate.

Figure 4:
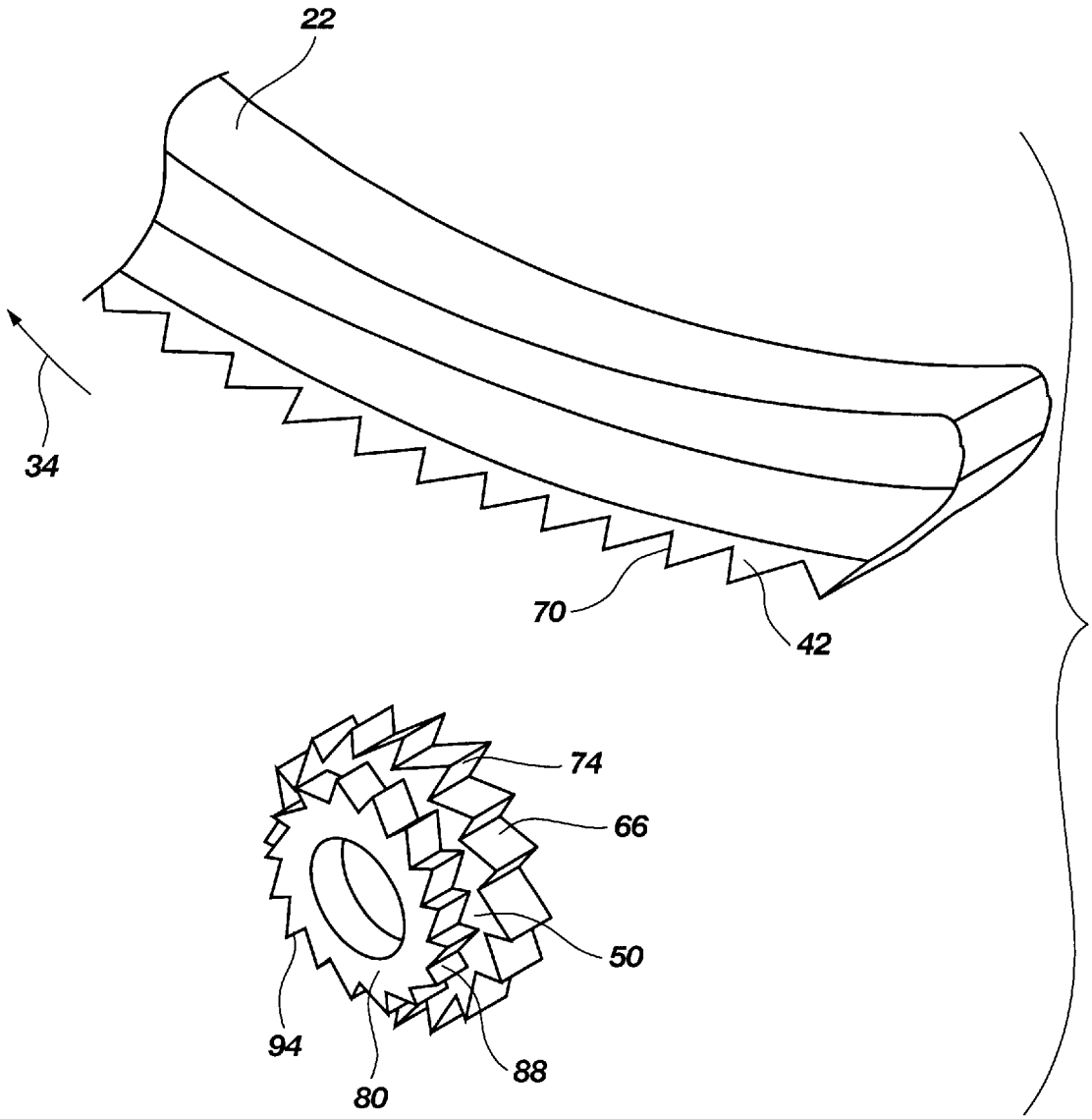
FIG. 4 is a detailed view of a portion of a locking mechanism in accordance with the present invention.

Referring to FIG. 4, the jaw member 22 may include serrated teeth 42 with blunt edges or faces 70 facing in the opening direction 34. Thus, the teeth 42 point towards the open direction 34. Similarly, the gears, represented by gear 50, may include serrated teeth 66 which have blunt surfaces 74 which face in the opposite direction and which abut the blunt faces 70 of the teeth 42 of the jaw member 22.

Referring again to FIGS. 1–3, the locking mechanism 14 advantageously may include a pair of secondary gears 80 and 84 connected to the respective primary gears 50 and 54. Each secondary gear 80 and 84 may be affixed adjacent to the respective primary gear 50 and 54, to rotate together, and located such that they have concentric axes of rotation. The primary and secondary gears may be keyed together or integrally formed. The first primary and first secondary teeth 50 and 80 form a first gear assembly, while the second primary and second secondary teeth 54 and 84 form a second gear assembly. Referring to FIG. 4, the secondary gears, represented by gear 80, also have a plurality of teeth 88 which may be serrated to point in a direction opposite that of the teeth 66 of the primary teeth 50, or have blunt faces 94 which face opposite the blunt faces 54 of the primary teeth 50.

Referring again to FIGS. 1–3, the locking mechanism 14 further may include a latch 98 which selectively engages at least one of the secondary gears 80 and 84 to selectively resist rotation of the secondary gears 80 and 84, and thus the primary gears 50 and 54, and thus resist pivoting of the jaw member 22. The latch 98 advantageously is disposed between the pair of gears 50 and 54, or 80 and 84. Thus, the latch 98 is blocked from tampering by the gears 50 and 54, or 80 and 84.

The latch 98 pivots about a pivot pin 102 which may be secured to the lock housing 40, or either cheek member 18 and 38. The latch 98 preferably includes a pair of arms 106 and 110 which extend generally in opposite directions from one another and the pivot pin 102. The arms 106 and 110 may be arcuate in order to best engage the teeth 88 of the secondary gears 80 and 84, which may be serrated or angled. Preferably, the latch 98 advantageously is oriented so that each arm 106 and 110 is located to abut the teeth 88 or blunt surfaces 94 of the secondary gears 80 and 84 as the secondary gears 80 and 84 rotate in a release direction, or in a counter clockwise direction with respect to FIG. 2.

A spring member 114 is disposed in the lock housing 40 to bear against the latch 98 and force the arms 106 and 110 against the secondary gears 80 and 84. Preferably, the spring member 114 is a curved or arcuate leaf spring with a first end abutting the lock housing 40 or the inner member 46, and a second end abutting the latch 98 or one of the arms 106 and 110. Thus, the latch 98 is held in or biased towards a lock position.

In addition, a stop member 118 may be selectively movable within the lock housing 40. The stop member 118 may be moved between a first stop position, shown in FIGS. 2 and 6, and second free position, shown in FIG. 5. In the first stop position, the stop member 118 abuts the latch 98 to prevent the latch 98 from pivoting, and thus preventing the gears 80 and 84 and 50 and 54 from rotating, and thus preventing the jaw member 22 from pivoting. In the second free position, the stop member 118 allows the latch 98 to pivot. The latch 98 may include an indentation 122 formed in one of the arms 106 to receive the stop member 118 as the latch 98 pivots. A pair of indentations 126 may be formed in the stop member 118 to receive a detent member 130. A detent member 130 may include a protrusion 134. The detent member 130 is located adjacent the stop member 118 so that the protrusion 134 is received within the indentations 126 as the stop member 118 moves. The detent member 130 may be a thin sheet of metal similar to a leaf spring so as to bend out of the way as the stop member 118 moves, but maintain the stop member 118 in either position with the protrusion 134 nesting in either indentation 126.

Figure 5:
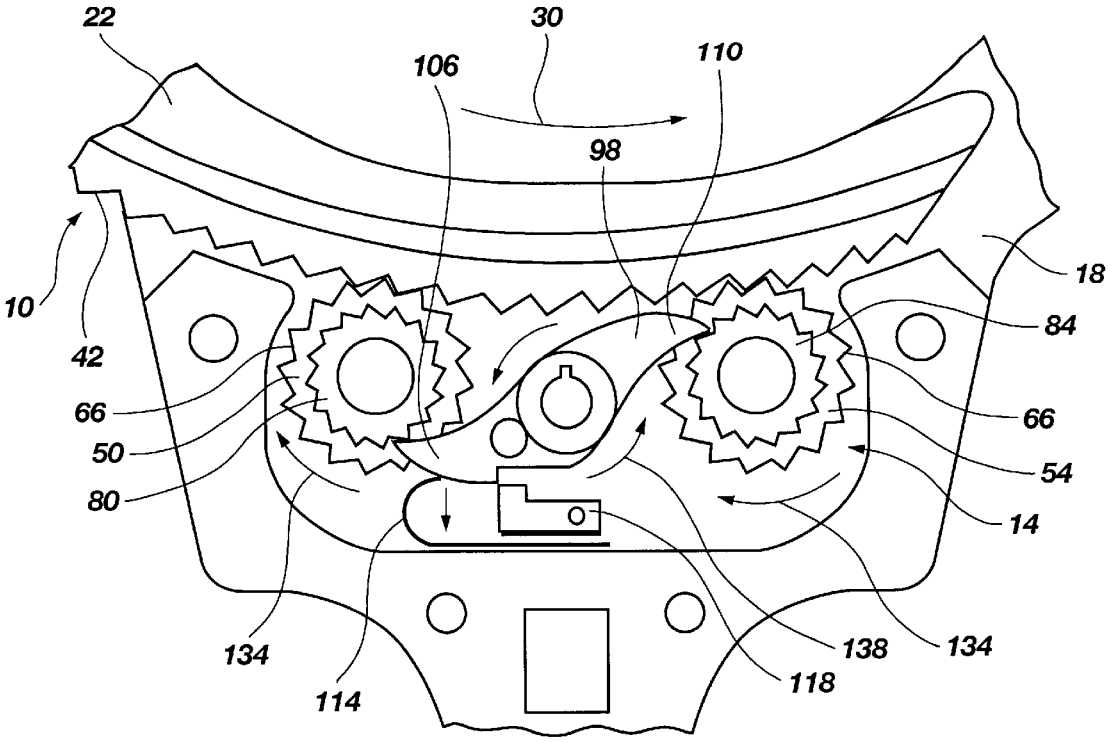
FIGS. 5–8 are side views of a locking mechanism in accordance with the present invention.

In FIGS. 5–8, the operation of the handcuff 10 and locking mechanism 114 is illustrated. Initially, the handcuff 10 may be in an open position, or the cheek and jaw members 18 and 22 may be in an open position, to receive the user's wrist, ankle or other object. The cheek and jaw members 18 and 22 may be completely open, or merely form an opening large enough to receive a user's hand, foot or other object. Referring to FIG. 5, the cheek and jaw members 18 and 22 pivot in a closed direction, indicated by arrow 30, towards one another to form a ring surrounding the user's wrist, ankle, or other object. As the cheek and jaw members 18 and 22 pivot in the closed direction, the ring becomes smaller to match the size of the user's wrist, ankle, or other object, and thus prevents withdrawal of the user's hand, foot, or other object.

In addition, as the cheek and jaw members 18 and 22 pivot in the closed direction 30, the teeth 42 of the jaw member 22 engage the teeth 66 of the pair of primary gears 50 and 54, causing the primary gears 50 and 54 to rotate in a secure direction, indicated by arrows 134. Thus, with respect to FIG. 5, as the jaw member 22 pivots counterclockwise, the pair of primary gears 50 and 54 rotate in a clockwise direction.

In addition, the stop member 118 is disposed in the free position, which allows the latch 98 to pivot. Although the spring member 114 biases the latch 98 in a locked position against the secondary pair of gears 80 and 84, the rotation of the pair of secondary gears 80 and 84 overcomes the force of the spring member 114, causing the latch 98 to pivot away from the lock position and allowing the gears 50 and 54 and 80 and 84 to rotate in the secure position 134. It will be noted that the serrated configuration of the teeth 88 of the secondary gears 80 and 84, and the arcuate configuration of the arms 106 and 110 of the latch, facilitate a sliding engagement between the teeth 88 of the secondary gears 80 and 84 and the arcuate arms 106 and 110, to facilitate movement of the jaw member 22 in the closed direction 30. As the gears SO, 54, 80 and 84 rotate in the secure direction 134, the latch 98 is caused to pivot slightly towards an unlocked position, indicated by arrows 138.

Figure 6:
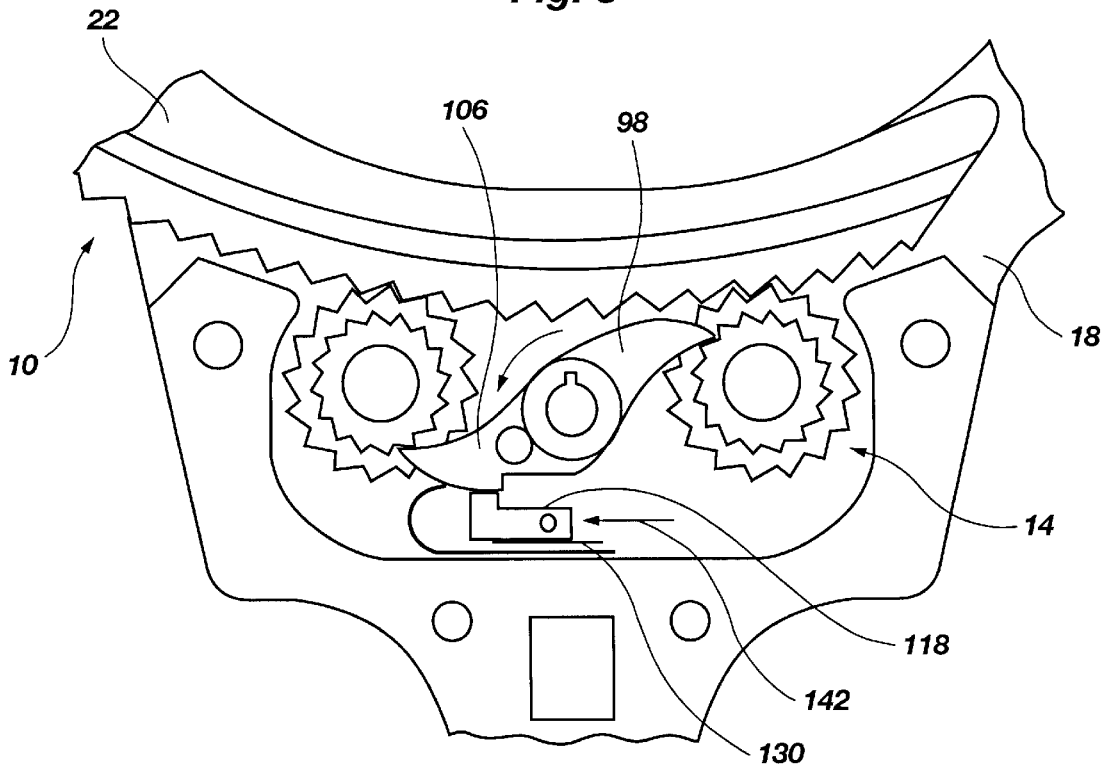

The jaw member 22 continues to pivot in the closed direction 30 until the ring formed by the jaw members 18 and 22 are properly sized around the user's wrist, ankle, or other object. Referring to FIG. 6, the stop member 118 is moved, indicated by arrow 142, to the first stop position where it abuts the latch 98 or one of the arms 106. The stop member is held in place by the detent member 130. The stop member 118 prevents the latch 98 from pivoting, and thus prevents the gears 50, 54, 80 and 84 from rotating in either direction, and thus prevents the jaw member 22 from pivoting in either direction. Even without the stop member 118, the spring member 114 forces the latch 98, or arms 106 and 110, against the gears 80 and 84 and into engagement with the teeth 88 to prevent rotation of the gears 50, 54, 80 and 84 in a release direction.

Figure 7:
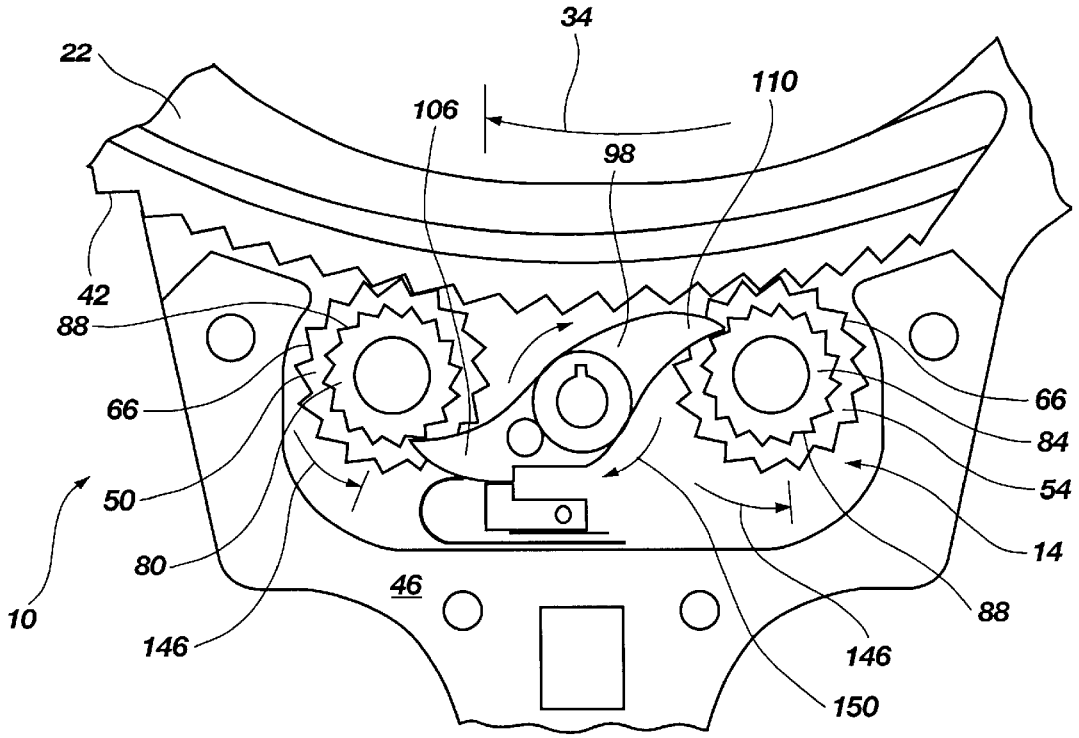

Referring to FIG. 7, any attempt to move the jaw member 22 in the open direction, indicated by arrow 34, is prevented by the lock mechanism 14. Movement of the jaw member 22 in the open direction 34 tends to exert a force on the pair of primary gears 50 and 54, which tends to cause the primary gears 50 and 54 to rotate in a release direction, indicated by arrows 146. As the gears 50, 54, 80 and 84 attempt to rotate in the release direction 146, the teeth 88 of the secondary gears 80 and 84 engage the arms 106 and 110 of the latch 98, and exert a force on the latch 98 that tends to cause the latch 98 to pivot towards the locked position, indicated by arrows 150. Therefore, any force exerted on the cheek and jaw members 18 and 22 in the open direction 34 translates through the gears 50, 54, 80 and 84 to the latch 98, adding additional force to force the latch into engagement with the secondary gears 80 and 84.

Figure 8:
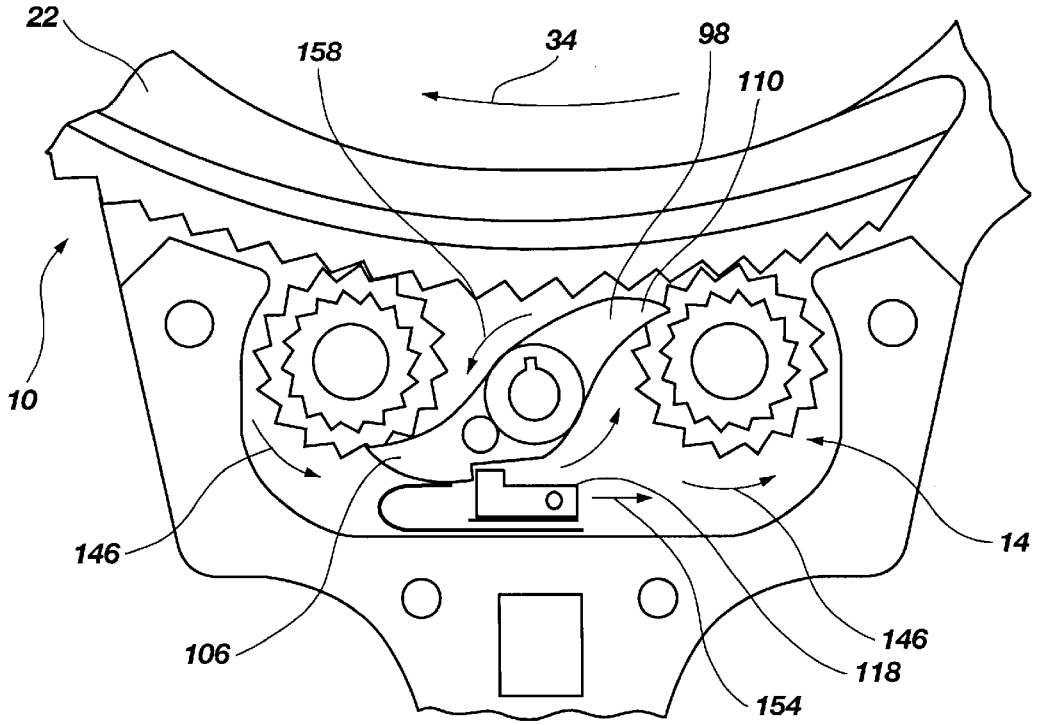

Referring to FIG. 8, the handcuff 10 is released by sliding or moving the stop member 118 into the free position, indicated by arrow 154. In addition, the latch 98 is pivoted to the unlocked position, indicated by arrows 158, causing the arms 106 and 110 to move away from the teeth 88 of the secondary gears 80 and 84. Thus, movement of the jaw member 22 in the open direction 34 causes the gears 50, 54, 80 and 84 to rotate in the release direction, indicated by arrows 146. Because the latch 98 has been pivoted to the unlocked position, the gears are free to rotate in the release direction 146.

Referring again to FIGS. 1 and 3, one of the cheek members 38, or the lock housing 40, may include a keyhole 160 for receiving a key (not shown), as is well known in the art. Thus, a key may be received through the keyhole 168 to engage the latch 98, and to pivot the latch to the unlocked position. In addition, a secondary keyhole 164 may also be formed in one of the cheek members 38 or lock housing 40, through which another portion of the key may be inserted to engage the stop member 118.

As indicated above, the handcuff 10 may include a chain 170 for securing the handcuff 10 to another handcuff or to another object. Thus, an enlarged opening 174 may be formed in the inner member 46 for receiving an enlarged end 178 of a connection member 182 attached to the chain 170. In addition, the handcuff 10 may include a secondary opening 186 which may extend through the cheek members 18 and 38 and the inner member 46 for receiving a secondary chain 190. The secondary opening 186 may be used to couple the handcuff 10 to another pair of handcuffs or another object, such as a chain 190.

Referring again to FIG. 7, the pair of gears 50 and 54 and the latch 98 disposed between the gears 50 and 54 or 80 and 84 advantageously prevent unauthorized tampering with the latch 98. The pair of gears 50 and 54 advantageously prevent the unauthorized insertion of a foreign object between the jaw member 22 and the inner member 46, thus preventing a foreign object from being inserted into the lock housing 40 to manipulate the latch 98.

Figure 9:
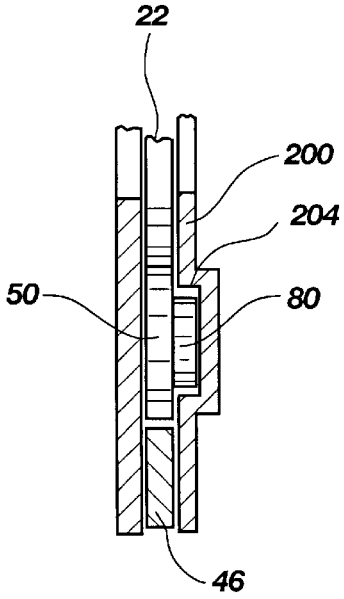
FIG. 9 is a cross-sectional side view of a locking mechanism in accordance with the present invention taken along line 9—9 of FIG. 12.

Referring to FIGS. 1 and 9, the primary and secondary gears 50 and 54 and 80 and 84 also advantageously prevent unauthorized tampering. The jaw member 22, primary gears 50 and 54, and inner member 46 may define a generally planar layer in which they are disposed. The secondary gears 80 and 84 and latch 98 advantageously are disposed outside the layer defined by the jaw member 22, primary gears 50 and 54, and the inner member 46. Thus, the latch 98 and secondary gears 80 and 84 are offset from any opening or gap 48 and 49 existing between the jaw member 22 and inner member 46. Therefore, the latch 98 is even more difficult to reach with a foreign object. As shown in FIG. 9, one of the cheek members 200 is formed with an indentation 204 or pocket for receiving the secondary gears 80 and 84 and latch 98.

Figure 10:
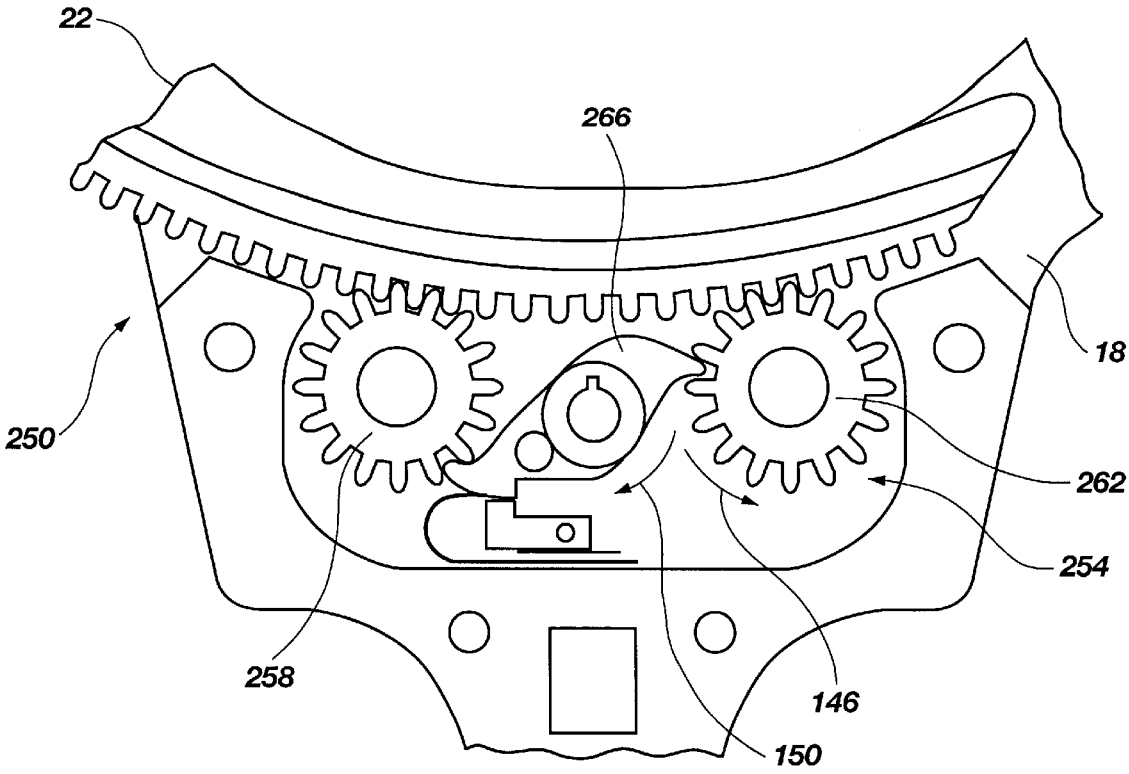
FIG. 10 is a side view of another locking mechanism in accordance with the present invention.

Referring to FIG. 10, another handcuff 250 may be provided with a locking mechanism 254 in accordance with the present invention which utilizes only a single pair of spaced-apart gears 258 and 262 which are similar in many respects to the pair of primary gears 50 and 54 described above. A latch 266 may be disposed and oriented to directly engage the gears 258 and 262. Again, the latch 266 may be oriented such that any rotation of the gears 250 and 262 in the release direction 146 causes the latch 266 to further pivot towards the locked position, as indicated by arrow 150.

Figure 11:
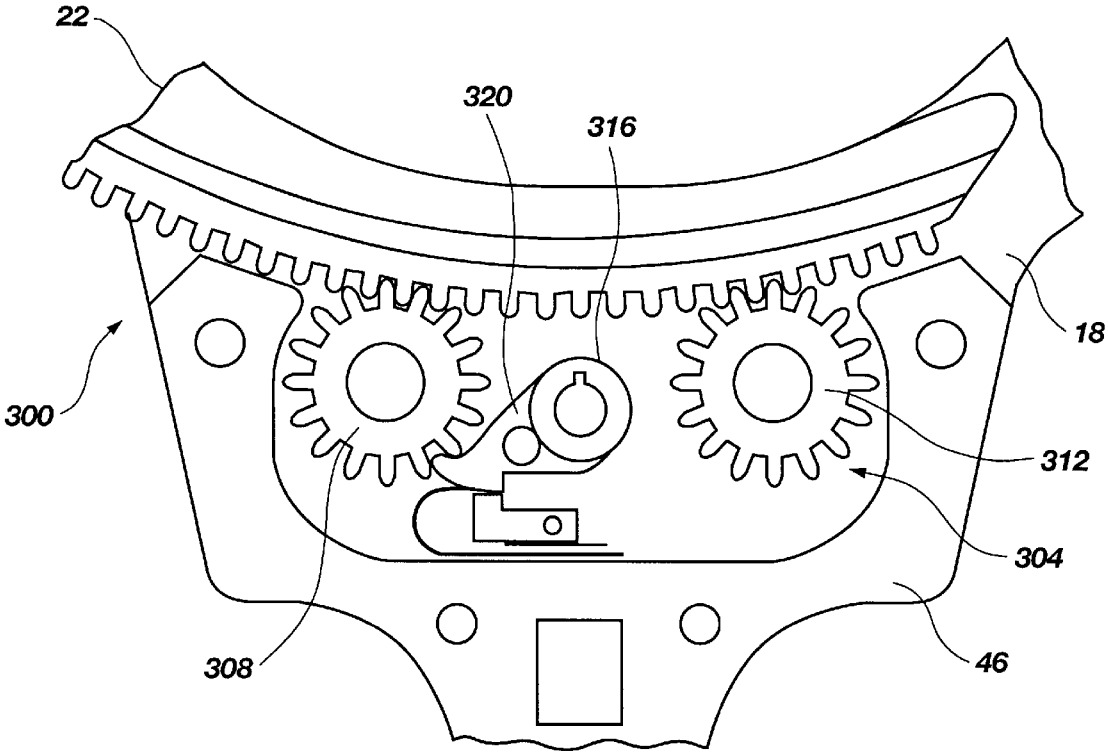
FIG. 11 is a side view of another locking mechanism in accordance with the present invention.
Figure 12:
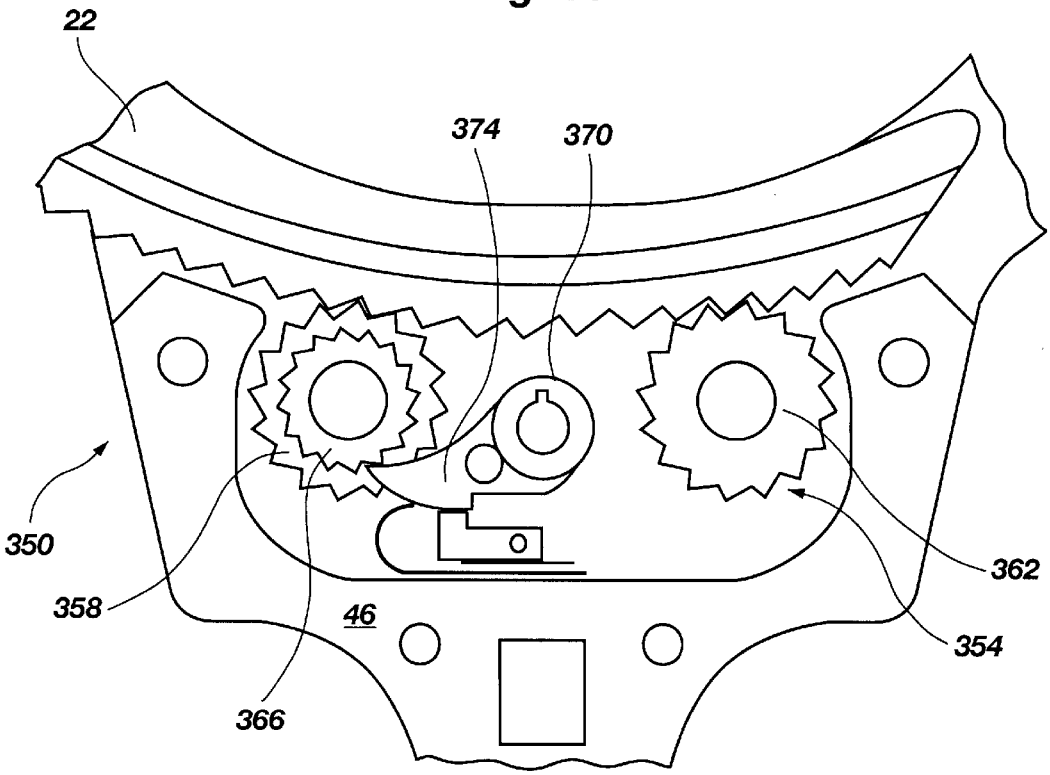
FIG. 12 is a side view of another locking mechanism in accordance with the present invention.

Referring to FIGS. 11 and 12, handcuffs may be provided with a locking mechanism in which the latch engages only one of the gears, such that one of the gears is a locking gear while the other gear acts to block unauthorized entrance of foreign objects into the locking mechanism to manipulate the latch. Referring to FIG. 11, a handcuff 300 has a locking mechanism 304 with a pair of gears 308 and 312 which are similar in many respects to the gears described above. The first gear 308 acts as a locking gear, while the second gear 312 acts as a blocking gear. A latch 316 includes a single arm 320 which engages the locking gear 308. The blocking gear 312 resists the unauthorized force entrance of a foreign object between the jaw member 22 and the inner member 46 to manipulate the latch 316.

Referring to FIG. 12, a handcuff 350 has a locking mechanism 354 with a primary gear 358 similar in many respects to the gears described above. A secondary gear 366 is attached to and rotates with the first primary gear 358. A latch 370 includes a single arm 374 which engages a secondary gear 366. As described above, the latch 370 and secondary gear 366 are located out of the plane defined by the jaw member 22, inner member 46, and primary gears 358 and 362.

Figure 13:
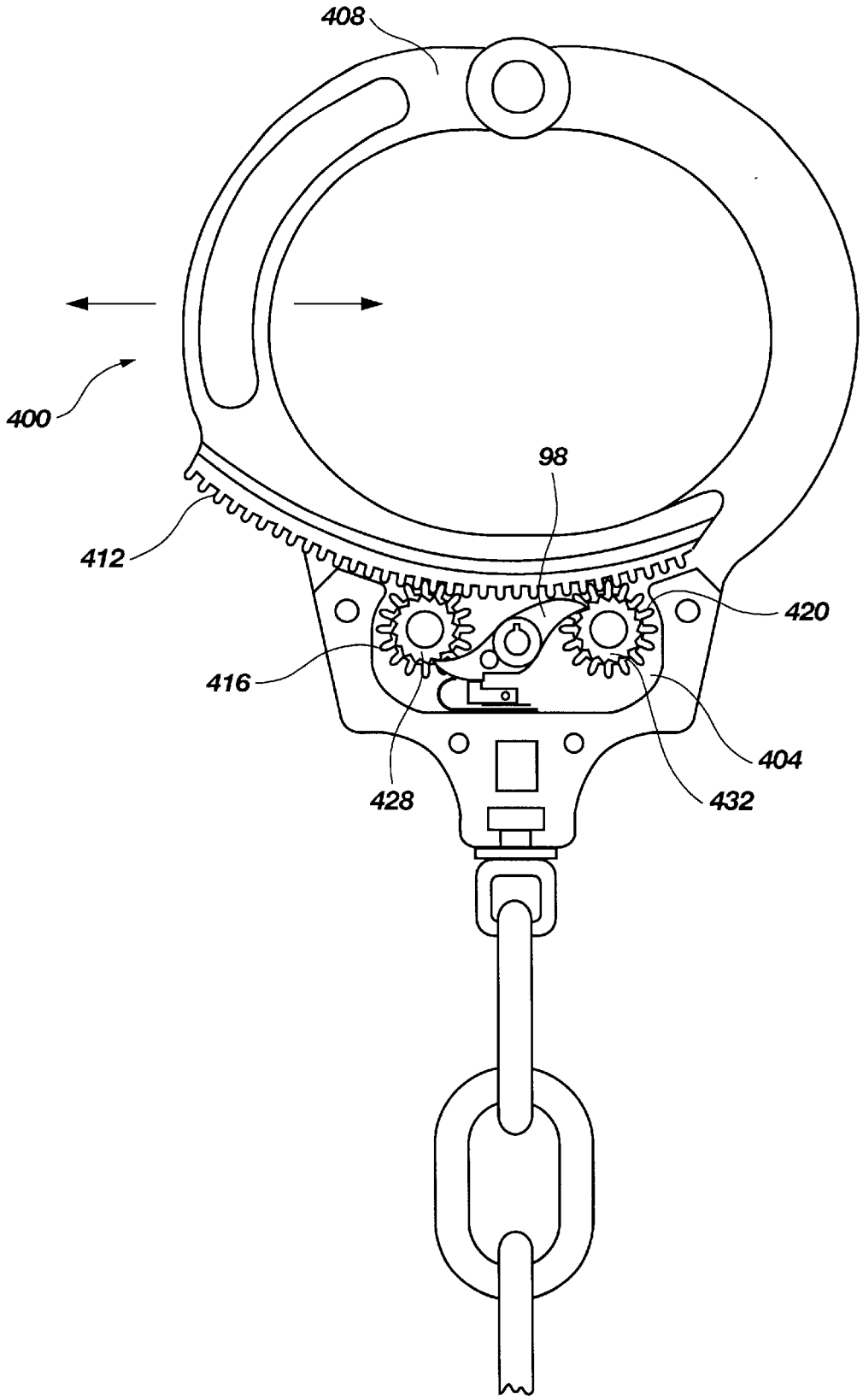
FIG. 13 is a broken away side view of another handcuff in accordance with the present invention.
Figure 14:
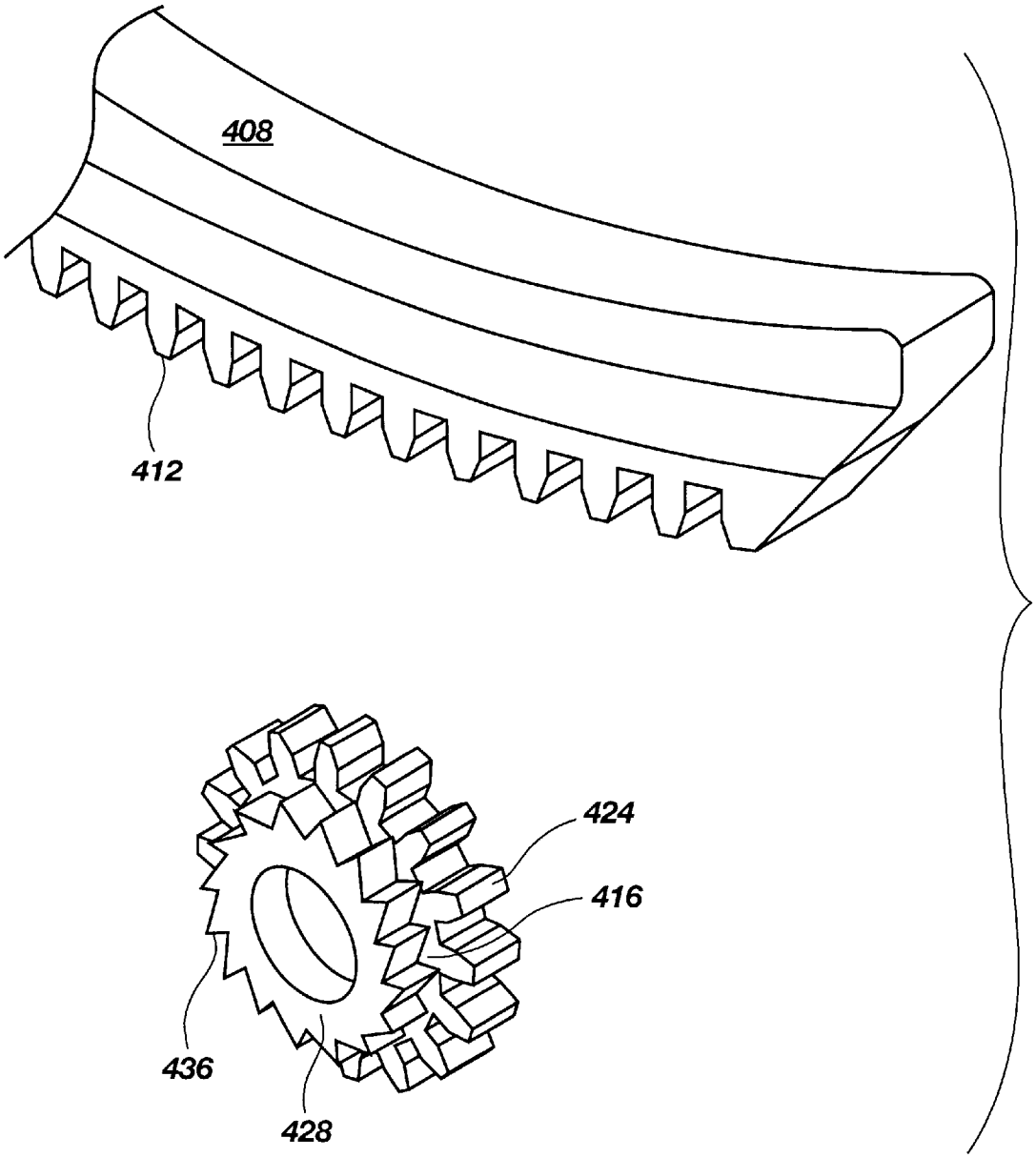
FIG. 14 is a detailed view of a portion of another locking mechanism in accordance with the present invention.

As described above, the gears may include serrated teeth or have pointed teeth which are angled in particular directions to create blunt, abutting faces. Referring to FIGS. 13 and 14, the various teeth may include more gear-like teeth. A handcuff 400 includes a locking mechanism 404 and a jaw member 408 which includes teeth 412 which extend radially outward in a more gear-like fashion. First and second primary gears 416 and 420 are provided with teeth 424 which similarly point radially outward in a more gear-like fashion. Secondary teeth 436 may be provided with the same serrated configuration.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is clamed is:

1. A handcuff, comprising:

cheek and jaw members pivotally secured and movable between open and closed positions;

teeth, formed on the jaw member; and a locking mechanism, carried by the cheek member, including:

a first gear assembly including:

a primary gear having a plurality of teeth that engage the teeth of the jaw member in the closed position and rotate as the cheek and jaw members pivot;

a secondary gear, secured to and rotatable with the primary gear;

a second gear assembly, spaced-apart form the first gear assembly, including:

a primary gear having a plurality of teeth that engage the teeth of the jaw member in the closed position and rotate as the cheek and jaw members pivot; and a secondary gear, secured to and rotatable with the primary gear; and a latch that pivots to releasably engage both of the secondary gears, to prevent the secondary and primary gears from rotating, and to prevent the cheek and jaw members from moving to the open position.

2. A handcuff in accordance with claim 1, wherein the jaw member and primary gears define and are disposed in a planar layer; and wherein the latch is disposed outside the planar layer defined by the jaw member and primary gears.

3. A handcuff in accordance with claim 1, wherein the secondary gears are disposed adjacent the respective primary gears; and wherein the primary and secondary gears of each gear assembly have concentric axes of rotation.

4. A handcuff in accordance with claim 1, wherein pivotal movement of the cheek and jaw members away from one another in an open direction exerts a force tending to cause the gear assemblies to rotate in a release direction; and wherein the latch is oriented with respect to the gear assemblies such that any rotation of the gear assemblies in the release direction exerts a force on the latch tending to cause the latch to pivot towards a lock position.

5. A handcuff in accordance with claim 1, wherein the primary and secondary gears have teeth angled in opposite directions.

6. A handcuff in accordance with claim 1, wherein the teeth of the jaw member include serrated teeth having blunt edges; and wherein the teeth of the primary gears include serrated teeth having blunt edges to abut to the blunt edges of the serrated teeth of the jaw member.

7. A handcuff in accordance with claim 1, further comprising:

a spring member that engages the latch to force the latch to engage the secondary gears.

8. A handcuff in accordance with claim 1, further comprising:

a stop member selectively movable between (i) a first stop position abutting to the latch to prevent the latch from pivoting, and (ii) a second free position to allow the latch to pivot.

9. A handcuff in accordance with claim 1, further comprising:

a lock housing, carried by the check member, having a pocket formed therein; and the pocket being located outside a planar layer defined by and containing the jaw member and the primary gear; and the latch being disposed in the pocket of the lock housing, and located outside the planar layer defined by the jaw member and the gear, to resist unauthorized tampering with the latch.

10. A handcuff, comprising:

cheek and jaw members pivotally secured and movable between open and closed positions;

a plurality of teeth, formed on the jaw member;

a pair of spaced-apart gears, rotatably coupled to the cheek member, each having a plurality of teeth that engage the teeth of the jaw member and rotate as the cheek and jaw members pivot;

the jaw member and gears defining and being disposed in a planar layer; and a latch, pivotally coupled to the cheek member and disposed outside the planar layer defined by the jaw member and gears, to selectively prevent rotation of the gears, and to selectively prevent pivoting of the cheek and jaw members to the open position.

11. A handcuff in accordance with claim 10, wherein the gears are a primary gears; and further comprising:

a secondary gear, secured to and rotatable with one of the primary gears, and disposed outside the planar layer defined by the jaw member and primary gears; and wherein the latch releasably engages the secondary gear, to prevent the secondary and primary gears from rotating, and to prevent the cheek and jaw members from moving to the open position.

12. A handcuff in accordance with claim 11, wherein the primary and secondary gears have teeth angled in opposite directions.

13. A handcuff in accordance with claim 10, wherein the latch pivots between (i) a lock position in which the latch prevents rotation of the pair of gears, and thus prevents pivoting of the cheek and jaw members to the open position, and (ii) an unlock position in which the latch allows rotation of the pair of gears, and thus allows pivoting of the cheek and jaw members to the open position.

14. A handcuff in accordance with claim 10, wherein pivotal movement of the cheek and jaw members away from one another in an open direction exerts a force tending to cause the pair of gears to rotate in a release direction; and wherein the latch is oriented with respect to the pair of gears such that any rotation of the gears in the release direction exerts a force on the latch tending to cause the latch to pivot towards a lock position.

15. A handcuff in accordance with claim 10, wherein each of the gears is a primary gear, and further comprising:

a pair of secondary gears, each secured to and rotatable with one of the primary gears, and disposed outside the planar layer defined by the jaw member and primary gears; and wherein the latch releasably engages both of the secondary gears, to prevent the secondary and primary gears from rotating, and to prevent the cheek and jaw members from moving to the open position.

16. A handcuff in accordance with claim 10, wherein the teeth of the jaw member include serrated teeth having blunt edges; and wherein the teeth of the gears include serrated teeth having blunt edges to abut to the blunt edges of the serrated teeth of the jaw member.

17. A handcuff in accordance with claim 10, further comprising:

a spring member that engages the latch to force the latch to engage the gears.

18. A handcuff in accordance with claim 10, further comprising:

a stop member selectively movable between (i) a first stop position abutting to the latch to prevent the latch from pivoting, and (ii) a second free position to allow the latch to pivot.

19. A handcuff in accordance with claim 10, further comprising:

a lock housing, carried by the check member, having a pocket formed therein; and the pocket being located outside a planar layer defined by and containing the jaw member and the primary gear; and the latch being disposed in the pocket of the lock housing, to resist unauthorized tampering with the latch.

20. A handcuff comprising:

a cheek member having a lock housing;

a jaw member, pivotally secured to the check member, movable between open and closed positions and having a plurality of teeth formed thereon;

a gear, rotatably disposed in the lock housing of the cheek member, having a plurality of teeth that engage and intermesh with the teeth of jaw member and rotate as the jaw member pivots;

the jaw member and the gear defining and being disposed in a planar layer;

the lock housing having a pocket formed therein and located outside the planar layer of the jaw member and the gear; and a latch, pivotally coupled to the lock housing, to selectively prevent rotation of the gear, and to selectively prevent pivoting of the cheek and jaw members to the open position; and the latch being located in the pocket of the lock housing, and located outside the planar layer defined by the jaw member and the gear, to resist unauthorized tampering with the latch.

21. A handcuff in accordance with claim 20, wherein the gear is a primary gear; and further comprising:

a secondary gear, secured to and rotatable with the primary gear, and disposed in the pocket of the lock housing and outside the planar layer defined by the jaw member and the primary gear; and wherein the latch releasably engages the secondary gear, to prevent the secondary and primary gears from rotating, and to prevent the cheek and jaw members from moving to the open position.

22. A handcuff in accordance with claim 21, wherein the primary and secondary gears have teeth angled in opposite directions.

23. A handcuff in accordance with claim 20, further comprising:

a pair of spaced-apart gears, rotatably coupled to the cheek member, each having a plurality of teeth that engage the teeth of the jaw member and rotate as the cheek and jaw members pivot.

24. A handcuff in accordance with claim 23, wherein the latch pivots between (i) a lock position in which the latch prevents rotation of the pair of gears, and thus prevents pivoting of the cheek and jaw members to the open position, and (ii) an unlock position in which the latch allows rotation of the pair of gears, and thus allows pivoting of the cheek and jaw members to the open position.

25. A handcuff in accordance with claim 23, wherein pivotal movement of the cheek and jaw members away from one another in an open direction exerts a force tending to cause the pair of gears to rotate in a release direction; and wherein the latch is oriented with respect to the pair of gears such that any rotation of the gears in the release direction exerts a force on the latch tending to cause the latch to pivot towards a lock position.

26. A handcuff in accordance with claim 23, wherein each of the gears is a primary gear, and further comprising:

a pair of secondary gears, each secured to and rotatable with one of the primary gears, and disposed in the pocket of the lock housing and outside the planar layer defined by the jaw member and primary gears; and wherein the latch releasably engages both of the secondary gears, to prevent the secondary and primary gears from rotating, and to prevent the cheek and jaw members from moving to the open position.

* * * * *